US009023195B2

(12) United States Patent
Tasaka et al.

(10) Patent No.: US 9,023,195 B2
(45) Date of Patent: May 5, 2015

(54) PROCESS FOR HYDROTREATING NAPHTHA FRACTION AND PROCESS FOR PRODUCING HYDROCARBON OIL

(75) Inventors: Kazuhiko Tasaka, Tokyo (JP); Yuichi Tanaka, Tokyo (JP); Marie Iwama, Tokyo (JP)

(73) Assignees: Japan Oil, Gas and Metals National Corporation, Tokyo (JP); Inpex Corporation, Tokyo (JP); JX Nippon Oil & Energy Corporation, Tokyo (JP); Japan Petroleum Exploration Co., Ltd., Tokyo (JP); Cosmo Oil Co., Ltd., Tokyo (JP); Nippon Steel Engineering Co., Ltd., Tokyo (JP)

( * ) Notice: Subject to any disclaimer, the term of this patent is extended or adjusted under 35 U.S.C. 154(b) by 341 days.

(21) Appl. No.: 13/504,158

(22) PCT Filed: Oct. 13, 2010

(86) PCT No.: PCT/JP2010/067927

§ 371 (c)(1),
(2), (4) Date: Apr. 26, 2012

(87) PCT Pub. No.: WO2011/055612

PCT Pub. Date: May 12, 2011

(65) Prior Publication Data

US 2012/0211401 A1 Aug. 23, 2012

(30) Foreign Application Priority Data

Nov. 6, 2009 (JP) ..... 2009-254916

(51) Int. Cl.
*C10G 45/72* (2006.01)
*C10G 45/02* (2006.01)
(Continued)

(52) U.S. Cl.
CPC *C10G 45/72* (2013.01); *C10G 2/32* (2013.01); *C10G 45/32* (2013.01); *C10G 45/58* (2013.01);
(Continued)

(58) Field of Classification Search
CPC ..... C10G 2/30; C10G 2/32; C10G 45/02; C10G 45/32; C10G 45/58; C10G 45/72
USPC ..... 208/95, 143, 144, 264
See application file for complete search history.

(56) References Cited

U.S. PATENT DOCUMENTS

| | | | | |
|---|---|---|---|---|
| 4,132,529 | A * | 1/1979 | Schwimmer | 585/401 |
| 2007/0014703 | A1 | 1/2007 | Schweitzer et al. | |
| 2010/0217055 | A1 | 8/2010 | Tanaka | |

FOREIGN PATENT DOCUMENTS

| | | |
|---|---|---|
| JP | 2009-041508 | 2/2009 |
| WO | 2009/041508 | 4/2009 |

OTHER PUBLICATIONS

Office Action dated Dec. 4, 2013 issued in corresponding CN Application No. 201080049106.0 [With English Translation of Search Report].

(Continued)

*Primary Examiner* — Renee E Robinson
(74) *Attorney, Agent, or Firm* — Kenyon & Kenyon LLP

(57) ABSTRACT

A process for hydrotreating a naphtha fraction that includes a step of estimating the difference between the naphtha fraction hydrotreating reactor outlet temperature and inlet temperature, based on the reaction temperature of the Fischer-Tropsch synthesis reaction and the ratio of the flow rate of the treated naphtha fraction returned to the naphtha fraction hydrotreating step relative to the flow rate of the treated naphtha fraction discharged from the naphtha fraction hydrotreating step, a step of measuring the difference between the naphtha fraction hydrotreating reactor outlet temperature and inlet temperature, and a step of adjusting the reaction temperature of the naphtha fraction hydrotreating step so that the measured difference between the naphtha fraction hydrotreating reactor outlet temperature and inlet temperature becomes substantially equal to the estimated difference between the naphtha fraction hydrotreating reactor outlet temperature and inlet temperature.

6 Claims, 2 Drawing Sheets

(51) Int. Cl.
*C10G 45/32* (2006.01)
*C10G 45/58* (2006.01)
*C10G 2/00* (2006.01)

(52) U.S. Cl.
CPC .. *C10G 2300/202* (2013.01); *C10G 2300/4081* (2013.01); *C10G 2/30* (2013.01); *C10G 45/02* (2013.01); *C10G 2300/1022* (2013.01); *C10G 2300/1044* (2013.01); *C10G 2300/4006* (2013.01); *C10G 2400/02* (2013.01)

(56) References Cited

OTHER PUBLICATIONS

International Search Report dated Nov. 16, 2010 issued in corresponding PCT Application No. PCT/JP2010/067927.

* cited by examiner

PROCESS FOR HYDROTREATING NAPHTHA FRACTION AND PROCESS FOR PRODUCING HYDROCARBON OIL

TECHNICAL FIELD

The present invention relates to a process for hydrotreating a naphtha fraction contained within hydrocarbon compounds produced by a Fischer-Tropsch synthesis reaction, and also relates to a process for producing a hydrocarbon oil.

This application is a national stage application of International Application No. PCT/JP2010/067927, filed Oct. 13, 2010, which claims priority to Japanese Patent Application No. 2009-254916, filed Nov. 6, 2009, the content of which is incorporated herein by reference.

BACKGROUND ART

As a process for producing hydrocarbons that can be used as feedstocks for liquid fuel products such as naphtha (raw gasoline), kerosene and gas oil, a process that employs a Fischer-Tropsch synthesis reaction (hereafter abbreviated as "FT synthesis reaction") which uses carbon monoxide gas (CO) and hydrogen gas ($H_2$) as a feedstock is already known.

Further, as a technology for producing liquid fuel base stocks from a gaseous hydrocarbon such as natural gas using the FT synthesis reaction, GTL (Gas To Liquids) Technology has been known. In this GTL Technology, a gaseous hydrocarbon such as natural gas is reformed to produce a synthesis gas containing carbon monoxide gas and hydrogen gas as main components, the synthesis gas is then subjected to the FT synthesis reaction to synthesize hydrocarbon compounds which are a mixture of hydrocarbons having a wide carbon number distribution, and further, the hydrocarbon compounds are hydroprocessed and fractionally distilled to produce hydrocarbon oils used for liquid fuel base stocks. According to the GTL Technology, liquid fuels containing substantially no environmentally hazardous substances such as sulfur compounds and aromatic hydrocarbons can be produced.

As the process for synthesizing hydrocarbon compounds via the FT synthesis reaction, a process in which the FT synthesis reaction is conducted by blowing the synthesis gas into a catalyst slurry prepared by suspending catalyst particles within a liquid hydrocarbon has been disclosed (see Patent Document 1).

In liquid fuel synthesizing systems that utilize the FT synthesis reaction for performing the aforementioned GTL Technology, the hydrocarbon compounds produced by the FT synthesis reaction is fractionally distilled, yielding a raw naphtha fraction, a raw middle distillate and a raw wax fraction. In this description, "raw naphtha fraction", "raw middle distillate" and "raw wax fraction" mean respectively each of the fractions that has not been subjected to hydroprocessing (hydrotreating or hydrocracking)

In the FT synthesis reaction, besides the targeted paraffinic hydrocarbons, olefins and oxygen-containing compounds such as alcohols are produced as by-products. These by-products are impurities, and their inclusion within the liquid fuel products is undesirable. Accordingly, in an upgrading step, which composes a liquid fuel synthesizing system and performs hydroprocessing and fractional distillation of the raw naphtha, raw middle distillate and raw wax fraction obtained from the FT synthesis reaction to produce the fuel base stocks, the structures of the hydrocarbons that constitute each of the above fractions are transformed as required, and at the same time, the above impurities contained within each of the fractions are removed. In other words, the raw naphtha fraction is subjected to hydrotreating, the raw middle distillate is subjected to hydrotreating that includes hydroisomerization, and the raw wax fraction is subjected to hydrocracking Of the various fractions constituting the hydrocarbon compounds obtained from the FT synthesis reaction, the raw naphtha fraction contains the highest concentration of the olefins and alcohols.

In the hydrotreating of the naphtha fraction, the olefins and oxygen-containing compounds such as alcohols contained within the raw naphtha fraction are removed by a hydrogenation reaction and hydrodeoxygenation reaction respectively. Because these reactions are highly exothermic, excessive temperature increase in the naphtha fraction hydrotreating reactor is a concern. Accordingly, a portion of the inactive naphtha fraction which has been hydrotreated in the naphtha fraction hydrotreating reactor (hereafter referred to as the "treated naphtha fraction") is typically returned to a point upstream from the naphtha fraction hydrotreating reactor, so that the freshly supplied raw naphtha fraction is diluted by this treated naphtha fraction before being supplied to the naphtha fraction hydrotreating reactor, and as a result, the excessive temperature increases in the reactor can be suppressed (see Patent Document 2).

On the other hand, in the hydrotreating of the naphtha fraction, the degree of progression of the above reactions has typically been controlled by adjusting the reaction temperature. Specifically, the treated naphtha fraction (in some cases, together with the raw naphtha fraction) is sampled and analyzed, and the residual concentration levels of the olefins and alcohols and the like within the treated naphtha, and/or the conversion thereof, are determined. Then, based on those results, the hydrotreating temperature (reaction temperature) is adjusted, and operations are controlled so as to achieve substantially no residual olefins and alcohols and the like within the treated naphtha.

CITATION LIST

Patent Document

[Patent Document 1] United States Patent Application, Publication No. 2007-0014703

[Patent Document 2] International Patent Application, Publication No. 2009-041508 pamphlet

SUMMARY OF INVENTION

Technical Problem

However, the type of process for adjusting the hydrotreating temperature described above requires the relatively complex operations of sampling and then analyzing the treated naphtha fraction (and in some cases the raw naphtha fraction). Moreover, because considerable time is required from sampling through to the completion of the analysis, ascertaining the degree of progression of the reaction without a time lag has proven impossible. As a result, the most appropriate action has not always been able to be undertaken at any particular time.

The present invention has been developed in light of the above circumstances, and has an object of providing a process for hydrotreating a naphtha fraction, in which the degree of progression of impurity removal can be ascertained rapidly without analyzing the treated naphtha fraction and the raw naphtha fraction, and the hydrotreating temperature can be adjusted accordingly, as well as providing a process for producing a hydrocarbon oil of naphtha fraction using the process for hydrotreating a naphtha fraction.

Solution to Problem

A process for hydrotreating a naphtha fraction according to the present invention is a process in which a naphtha fraction contained within hydrocarbon compounds synthesized in a Fischer-Tropsch synthesis reaction step is hydrotreated in a naphtha fraction hydrotreating step, and a portion of a treated naphtha fraction discharged from the naphtha fraction hydrotreating step is returned to the naphtha fraction hydrotreating step, the process includes: a reactor temperature difference estimation step of estimating a difference between a naphtha fraction hydrotreating reactor outlet temperature and inlet temperature, based on a reaction temperature of the FT synthesis reaction step, and a ratio of a flow rate of the treated naphtha fraction returned to the naphtha fraction hydrotreating step relative to a flow rate of the treated naphtha fraction discharged from the naphtha fraction hydrotreating step, a reactor temperature difference measurement step of measuring the difference between the naphtha fraction hydrotreating reactor outlet temperature and inlet temperature, and a reaction temperature adjustment step of adjusting a reaction temperature of the naphtha fraction hydrotreating step so that the difference between the naphtha fraction hydrotreating reactor outlet temperature and inlet temperature measured in the reactor temperature difference measurement step becomes substantially equal to the difference between the naphtha fraction hydrotreating reactor outlet temperature and inlet temperature estimated in the reactor temperature difference estimation step.

In the process for hydrotreating a naphtha fraction according to the present invention, the difference between the naphtha fraction hydrotreating reactor outlet temperature and inlet temperature may be estimated in the reactor temperature difference estimation step based on a relationship between actual performances of the reaction temperature of the FT synthesis reaction step, the ratio of the flow rate of the treated naphtha fraction returned to the naphtha fraction hydrotreating step relative to the flow rate of the treated naphtha fraction discharged from the naphtha fraction hydrotreating step, and the difference between the naphtha fraction hydrotreating reactor outlet temperature and inlet temperature.

A process for producing a hydrocarbon oil according to the present invention includes: a Fischer-Tropsch synthesis reaction step of synthesizing hydrocarbon compounds from a synthesis gas comprising carbon monoxide gas and hydrogen gas by a Fischer-Tropsch synthesis reaction, a naphtha fraction hydrotreating step of hydrotreating a naphtha fraction contained within the hydrocarbon compounds synthesized in the Fischer-Tropsch synthesis reaction step in a naphtha fraction hydrotreating reactor, a naphtha fraction return step of returning a portion of a treated naphtha fraction discharged from the naphtha fraction hydrotreating step to the naphtha fraction hydrotreating step, a reactor temperature difference estimation step of estimating a difference between a naphtha fraction hydrotreating reactor outlet temperature and inlet temperature, based on a reaction temperature of the Fischer-Tropsch synthesis reaction step, and a ratio of a flow rate of the treated naphtha fraction returned to the naphtha fraction hydrotreating reactor relative to a flow rate of the treated naphtha fraction discharged from the naphtha fraction hydrotreating reactor, a reactor temperature difference measurement step of measuring the difference between the naphtha fraction hydrotreating reactor outlet temperature and inlet temperature, a reaction temperature adjustment step of adjusting a reaction temperature of the naphtha fraction hydrotreating step so that the difference between the naphtha fraction hydrotreating reactor outlet temperature and inlet temperature measured in the reaction temperature difference measurement step becomes substantially equal to the difference between the naphtha fraction hydrotreating reactor outlet temperature and inlet temperature estimated in the reactor temperature difference estimation step, and a naphtha fraction fractional distillation step of fractionally distilling the naphtha fraction treated in the naphtha fraction hydrotreating step, thereby obtaining a naphtha as a hydrocarbon oil.

In the process for producing a hydrocarbon oil according to the present invention, the difference between the naphtha fraction hydrotreating reactor outlet temperature and inlet temperature may be estimated in the reactor temperature difference estimation step based on the relationship between actual performances of the reaction temperature of the Fischer-Tropsch synthesis reaction step, the ratio of the flow rate of the treated naphtha fraction returned to the naphtha fraction hydrotreating step relative to the flow rate of the treated naphtha fraction discharged from the naphtha fraction hydrotreating step, and the difference between the naphtha fraction hydrotreating reactor outlet temperature and inlet temperature.

The above-mentioned "naphtha fraction hydrotreating reactor outlet temperature" and "inlet temperature" mean the temperatures of the mixture of the naphtha fraction and hydrogen gas passing through the outlet of the naphtha fraction hydrotreating reactor and inlet thereof respectively.

Advantageous Effects of Invention

According to the present invention, the degree of progression of a naphtha fraction hydrotreating step can be ascertained without analyzing the treated naphtha fraction and the raw naphtha fraction, and by adjusting the hydrotreating reaction temperature based on the ascertained degree of progression, the naphtha fraction hydrotreating step can be controlled appropriately and rapidly via a simple process. Furthermore, a hydrocarbon oil of naphtha fraction can be produced effectively.

DESCRIPTION OF EMBODIMENTS

First is a description of an example of a liquid fuel synthesizing system and a process for producing liquid fuel base stocks using the system to which the process for hydrotreating a naphtha fraction and process for producing a hydrocarbon oil according to the present invention may be applied to perform the GTL Technology.

Figure 1:
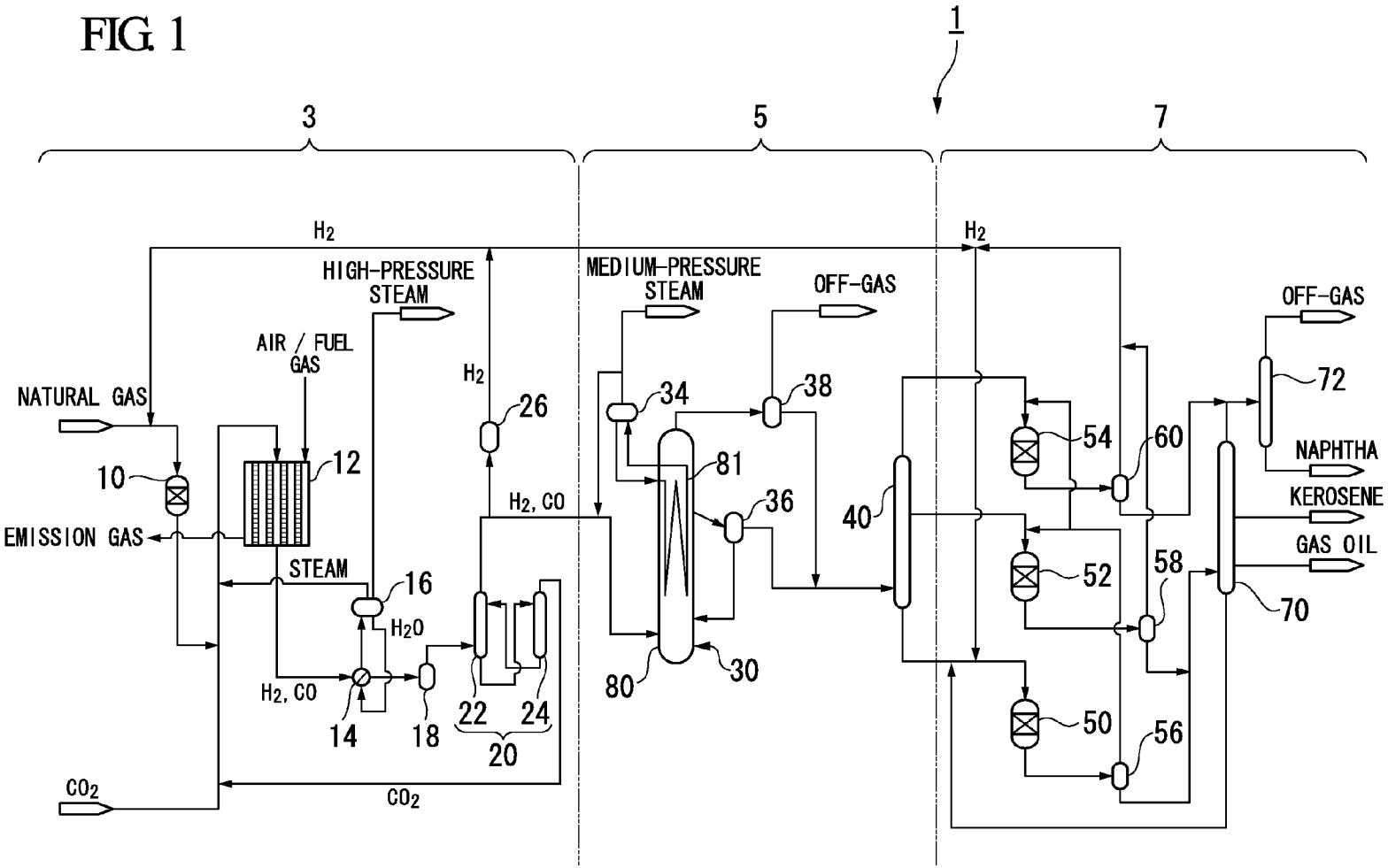
FIG. 1 is a schematic diagram illustrating the overall configuration of one example of a liquid fuel synthesizing system.

FIG. 1 illustrates an example of a liquid fuel synthesizing system for performing the GTL Technology.

This liquid fuel synthesizing system 1 includes a synthesis gas production unit 3, an FT synthesis unit 5, and an upgrading unit 7. In the synthesis gas production unit 3, a natural gas that functions as a hydrocarbon feedstock is reformed to produce a synthesis gas containing carbon monoxide gas and hydrogen gas. In the FT synthesis unit 5, hydrocarbon compounds are synthesized from the synthesis gas produced in the synthesis gas production unit 3 via an FT synthesis reaction. In the upgrading unit 7, the hydrocarbon compounds synthesized in the FT synthesis unit are hydroprocessed and fractionally distilled to produce base stocks for liquid fuels (such as naphtha, kerosene, gas oil and wax).

The synthesis gas production unit 3 is composed mainly of a desulfurization reactor 10, a reformer 12, a waste heat boiler 14, gas-liquid separators 16 and 18, a $CO_2$ removal unit 20, and a hydrogen separator 26.

The desulfurization reactor 10 is a hydrodesulfurizer or the like, and removes sulfur compounds from the natural gas that functions as the feedstock.

The reformer 12 reforms the natural gas supplied from the desulfurization reactor 10 to produce a synthesis gas containing carbon monoxide gas (CO) and hydrogen gas ($H_2$) as main components. As a reforming method, so-called steam-carbon dioxide gas reforming method, in which the desulfurized natural gas is reformed with carbon dioxide gas supplied from a carbon dioxide gas supplying source and steam supplied from a waste heat boiler 14 described below mixed therewith, is preferably adopted.

The waste heat boiler 14 recovers waste heat from the synthesis gas produced in the reformer 12 to generate a high-pressure steam.

The gas-liquid separator 16 separates the water that has been heated by heat exchange with the synthesis gas in the waste heat boiler 14 into a gas (high-pressure steam) and a liquid.

The gas-liquid separator 18 removes a condensed component from the synthesis gas that has been cooled in the waste heat boiler 14, and supplies a gas component to the $CO_2$ removal unit 20.

The $CO_2$ removal unit 20 has an absorption tower 22 that uses a liquid absorbent to remove carbon dioxide gas from the synthesis gas supplied from the gas-liquid separator 18, and a regeneration tower 24 that releases the carbon dioxide gas absorbed by the liquid absorbent, thereby regenerating the liquid absorbent.

The hydrogen separator 26 separates a portion of the hydrogen gas contained within the synthesis gas from which the carbon dioxide gas has already been separated by the $CO_2$ removal unit 20.

The FT synthesis unit 5 includes mainly a bubble column-type FT synthesis reactor 30, a gas-liquid separator 34, a catalyst separator 36, a gas-liquid separator 38, and a first fractionator 40.

The FT synthesis reactor 30 is a reactor that synthesizes hydrocarbon compounds from a synthesis gas by the FT synthesis reaction, and is composed mainly of a reactor main unit 80 and a cooling tube 81.

The reactor main unit 80 is a substantially cylindrical metal vessel, the inside of which contains a catalyst slurry prepared by suspending solid catalyst particles within liquid hydrocarbons (the FT synthesis reaction product).

Although the catalyst composing the catalyst slurry is not particularly limited, a catalyst comprising an inorganic oxide support such as silica and an active metal such as cobalt loaded thereon is preferably used.

The synthesis gas containing hydrogen gas and carbon monoxide gas as main components is injected into the catalyst slurry from a position in the bottom section of the reactor main unit 80. This synthesis gas that has been injected into the catalyst slurry forms bubbles that rise up through the catalyst slurry along the vertical direction of the reactor main unit 80 from bottom to top. During this process, the synthesis gas dissolves in the liquid hydrocarbons and makes contact with the catalyst particles, causing the synthesis reaction of the hydrocarbon compounds (the FT synthesis reaction) to proceed.

Further, as the synthesis gas rises up through in the reactor main unit 80 in the form of gas bubbles, an upward flow (air lift) is generated within the catalyst slurry in the reactor main unit 80. As a result, a circulating flow is generated within the catalyst slurry in the reactor main unit 80.

Although there are no limitations on reaction conditions within the reactor main unit 80, those reaction conditions described below, for example, are preferably selected. That is, a reaction temperature is preferably 150-300° C. in terms of increasing the carbon monoxide gas conversion and carbon numbers of the generated hydrocarbons. A reaction pressure is preferably 0.5-5.0 MPa. A hydrogen gas/carbon monoxide gas ratio (molar ratio) is preferably 0.5-4.0. Further, the carbon monoxide gas conversion is preferably 50% or more in terms of productivity of the hydrocarbon compounds.

An unreacted synthesis gas and hydrocarbon product generated by the FT synthesis reaction which is gaseous under the conditions within the reactor main unit 80 (gaseous hydrocarbon product) reaching the top of the reactor main unit 80 are discharged from the top of the reactor main unit 80 and supplied to the gas-liquid separator 38.

The gas-liquid separator 34 separates the water that has been heated by passage through the cooling tube 81 provided in the reactor main unit 80 into a steam (medium-pressure steam) and liquid water.

The catalyst separator 36 is connected to the middle section of the reactor main unit 80, and separates the catalyst particles and the hydrocarbon compounds from the catalyst slurry.

The gas-liquid separator 38 is connected to the top of the reactor main unit 80, and cools the unreacted synthesis gas and the gaseous hydrocarbon product so that a portion of the gaseous hydrocarbon product is liquefied and separated from the gas component.

The first fractionator 40 fractionally distills the liquid hydrocarbon compounds, which have been supplied from the FT synthesis reactor 30 via the catalyst separator 36 and the gas-liquid separator 38, into a number of fractions (raw naphtha fraction, raw middle distillate, raw wax fraction) according to their respective boiling points.

The upgrading unit 7 includes, for example, a wax fraction hydrocracking reactor 50, a middle distillate hydrotreating reactor 52, a naphtha fraction hydrotreating reactor 54, gas-liquid separators 56, 58 and 60, a second fractionator 70, and a naphtha stabilizer 72.

The wax fraction hydrocracking reactor 50 is connected to the bottom of the first fractionator 40, and hydrocracks the raw wax fraction supplied using hydrogen gas.

The middle distillate hydrotreating reactor 52 is connected to a middle section of the first fractionator 40, and hydrotreats the raw middle distillate supplied using hydrogen gas.

The naphtha fraction hydrotreating reactor 54 is connected to the top of the first fractionator 40, and hydrotreats the raw naphtha fraction supplied using hydrogen gas.

The gas-liquid separators 56, 58 and 60 are provided downstream from the reactors 50, 52 and 54 respectively, and separate the hydrotreating products or hydrocracking product discharged from each of the reactors into gas components containing hydrogen gas and liquid components of hydrocarbon oils respectively.

The second fractionator 70 is connected to the gas-liquid separators 56 and 58, and fractionally distills a mixture of the hydrocarbon oils supplied from each of the gas-liquid separators 56 and 58.

An uncracked wax fraction (with boiling point exceeding approximately 360° C.), that has not been sufficiently hydrocracked in the wax fraction hydrocracking reactor 50, is discharged from the bottom of the second fractionator 70, is returned to a position upstream of the wax fraction hydrocracking reactor 50, and then join the raw wax fraction to be hydrocracked once again in the wax fraction hydrocracking reactor 50.

A middle distillate (with boiling point approximately 150 to 360° C.), that is kerosene and gas oil fraction, is discharged from the middle section of the second fractionator 70, and is used as a base stock for kerosene and gas oil.

Meanwhile, hydrocarbons of C10 or less (with boiling point lower than approximately 150° C.) containing a naphtha fraction are discharged from the top of the second fractionator 70 and supplied to the naphtha stabilizer 72.

The naphtha stabilizer 72 fractionally distills the hydrocarbon oil containing a naphtha fraction supplied from the gas-liquid separator 60 and the second fractionator 70, and the resulting gas component having a carbon number of 4 or less is discharged from the top of the naphtha stabilizer 72 as a off gas, and is burned or utilized as a LPG source. On the other hand, the components having a carbon number of 5 or greater are recovered as a naphtha product from the bottom of the naphtha stabilizer 72.

(Process for Hydrotreating Naphtha Fraction)

Figure 2:
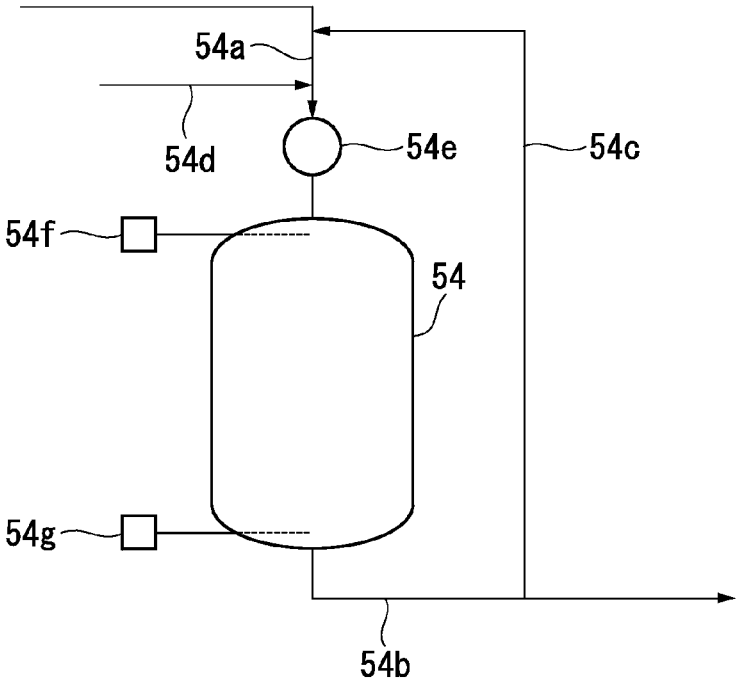
FIG. 2 is a schematic diagram illustrating a naphtha fraction hydrotreating reactor used in an embodiment of a process for hydrotreating a naphtha fraction according to the present invention, as well as the pipings and instruments attached to the naphtha fraction hydrotreating reactor.

FIG. 2 illustrates a naphtha fraction hydrotreating reactor 54 as well as the pipings and instruments attached thereto.

Next is a description of a process for hydrocracking a naphtha fraction of the invention in detail along with an example of the preferable embodiment referring to FIG. 1 and FIG. 2.

As illustrated in FIG. 1 and FIG. 2, a raw naphtha fraction supply line 54*a* that supplies the raw naphtha fraction from the first fractionator 40 and a treated naphtha fraction feed line 54*b* that feeds the treated naphtha fraction to the gas-liquid separator 60 are connected to the naphtha fraction hydrotreating reactor 54.

A return line 54*c* which branches off the treated naphtha fraction feed line 54*b* and is used for returning a portion of the treated naphtha fraction is connected to the raw naphtha fraction supply line 54*a*. Further, a hydrogen gas supply line 54*d* is also connected to the raw naphtha fraction supply line 54*a*, at a position downstream from where the return line 54*c* is connected, and a heater 54*e* is provided within the raw naphtha fraction supply line 54*a* at a position downstream from where the hydrogen gas supply line 54*d* is connected.

Furthermore, temperature measuring devices 54*f* and 54*g* are installed in the naphtha fraction hydrotreating reactor 54 at the inlet and outlet respectively, enabling the measurement of the inlet temperature and the outlet temperature of the fluid (mixture of the naphtha fraction and hydrogen gas) in the reactor.

In the process for hydrotreating a naphtha fraction according to the present embodiment, the raw naphtha fraction is supplied to the naphtha fraction hydrotreating reactor 54 from the first fractionator 40 via the raw naphtha fraction supply line 54*a*. Further, a portion of the treated naphtha fraction is returned to the raw naphtha fraction supply line 54*a* through the return line 54*c*, and hydrogen gas is supplied thereto through the hydrogen gas supply line 54*d*. Accordingly, the treated naphtha fraction and the hydrogen gas are mixed with the raw naphtha fraction (hereafter, the mixture obtained upon mixing the raw naphtha fraction with the treated naphtha fraction may also be referred to as the "mixed naphtha fraction").

Prior to entering the naphtha fraction hydrotreating reactor 54, the mixed naphtha fraction and the hydrogen gas are heated to a predetermined temperature by the heater 54*e*. Following heating, hydrotreating is performed in the naphtha fraction hydrotreating reactor 54 (naphtha fraction hydrotreating step). In this naphtha fraction hydrotreating step, the olefins in the raw naphtha fraction are hydrogenated and converted into paraffinic hydrocarbons, and alcohols therein are hydrodeoxygenated and converted into paraffinic hydrocarbons and water. As a result, the raw naphtha fraction is hydrotreated to obtain a treated naphtha fraction. Further, as a result of the hydrogenation of the olefins and the hydrodeoxygenation of the alcohols, both of which are exothermic reactions, the temperature of the fluid in the reactor (mixture of the naphtha fraction and hydrogen gas) is increased.

As described above, a portion of the treated naphtha fraction is returned to the naphtha fraction hydrotreating reactor 54 via the return line 54*c* and the raw naphtha fraction supply line 54*a*. Because the treated naphtha fraction, in which the olefins and alcohols, causing the exothermic reactions during the naphtha fraction hydrotreating step, have been removed, is inactive, by mixing the raw naphtha fraction with this treated naphtha fraction, the olefins and alcohols in the raw naphtha fraction are diluted, thereby reducing the amount of heat generated per unit volume of the naphtha fraction during the naphtha fraction hydrotreating step. The treated naphtha fraction that is not returned to the naphtha fraction hydrotreating step is brought into the gas-liquid separator 60 (see FIG. 1) via the treated naphtha fraction feed line 54*b*.

The naphtha fraction hydrotreating reactor 54 used in the above process for a naphtha fraction hydrotreating contains a hydrotreating catalyst.

As this hydrotreating catalyst, the types of catalysts conventionally used in petroleum refining, namely catalysts in which an active metal having a hydrogenation capability is loaded on an inorganic support, may be used.

Examples of metals that may be used as the active metal within the hydrotreating catalyst include one or more metals selected from the group consisting of metals belonging to groups 6, 8, 9 and 10 of the periodic table of elements. Specific examples of these metals include noble metals such as platinum, palladium, rhodium, ruthenium, iridium and osmium, as well as cobalt, nickel, molybdenum, tungsten and iron. Of these, platinum, palladium, nickel, cobalt, molybdenum and tungsten are preferred, and platinum and palladium are particularly preferred. Further, the use of a combination of a plurality of these metals is also preferable, and examples of preferred combinations include platinum-palladium, cobalt-molybdenum, nickel-molybdenum, nickel-cobalt-molybdenum and nickel-tungsten. "The periodic table of elements" refers to the long period type periodic table of elements prescribed by IUPAC (the International Union of Pure and Applied Chemistry).

Examples of the inorganic support that constitutes the hydrotreating catalyst include metal oxides such as alumina, silica, titania, zirconia and boria. Any one of these metal oxides may be used individually, or a mixture of two or more of these oxides, or a composite metal oxide thereof such as silica-alumina, silica-zirconia, alumina-zirconia, or alumina-boria may be used. Moreover, in order to improve the moldability and mechanical strength of the support, the support may also contain a binder. Examples of preferred binders include alumina, silica and magnesia.

In those cases where the active metal is an above-mentioned noble metal, the amount of the active metal within the hydrotreating catalyst, recorded as the mass of metal atoms relative to the mass of the support, is preferably within a range from approximately 0.1 to 3 mass %. Further, in those cases where the active metal is one of the above metals other than a noble metal, the amount of the active metal, recorded as the mass of metal oxide relative to the mass of the support, is preferably within a range from approximately 2 to 50 mass %. If the amount of the active metal is less than the above-mentioned lower limit, then the hydrotreating tends not to progress satisfactorily. In contrast, if the amount of the active metal exceeds the above-mentioned upper limit, then the dispersion of the active metal tends to deteriorate and the activity of the catalyst decreases. Moreover, the catalyst cost also increases.

The reaction temperature of the naphtha fraction hydrotreating step in the process for hydrotreating a naphtha fraction according to the present invention is determined based on the train of thought described below.

In the FT synthesis reaction step, the composition of the product is strongly dependent on the reaction temperature, with lower reaction temperatures resulting in an increase in the concentration of the olefins and alcohols within the product. Accordingly, the concentration of the olefins and alcohols within the raw naphtha fraction can be estimated on the basis of the reaction temperature in the FT synthesis reaction step.

Subsequently, based on the estimated value for the concentration of the olefins and alcohols contained within the raw naphtha fraction, and the ratio of the flow rate of the treated naphtha fraction returned to the naphtha fraction hydrotreating step relative to the flow rate of the treated naphtha fraction discharged from the naphtha fraction hydrotreating step (hereafter also referred to as the "treated naphtha fraction return ratio"), an estimated concentration is determined for the olefins and alcohols contained within the mixed naphtha fraction supplied to the naphtha fraction hydrotreating step. Furthermore, the heat of reaction for the hydrogenation of the olefins and the heat of reaction for the hydrodeoxygenation of the alcohols are known values. Accordingly, the amount of heat generated in the naphtha fraction hydrotreating step per unit volume of the mixed naphtha fraction in the case where all of the olefins are hydrogenated and all of the alcohols are hydrodeoxygenated in the naphtha fraction hydrotreating step, namely in the case where the conversion of the olefins and alcohols is 100%, can be estimated. Based on this estimated amount of the heat generation and the specific heat of the naphtha fraction and hydrogen gas, a temperature increase in the mixture of the naphtha fraction and hydrogen gas caused by the heat of reaction within the naphtha fraction hydrotreating reactor, namely a difference between the naphtha fraction hydrotreating reactor outlet temperature and inlet temperature (hereafter referred to as the "reactor temperature difference"), is estimated (reactor temperature difference estimation step). Then, the naphtha fraction hydrotreating reactor outlet temperature and inlet temperature are then actually measured, and the reactor temperature difference is determined (reactor temperature difference measurement step).

By subsequently comparing the reactor temperature difference estimated in the reactor temperature difference estimation step (hereafter referred to as the "estimated reactor temperature difference") and the reactor temperature difference actually measured in the reactor temperature difference measurement step (hereafter referred to as the "measured reactor temperature difference"), the conversion of the olefins and alcohols during the naphtha fraction hydrotreating step can be estimated. Based on this estimated value, the reaction temperature in the naphtha fraction hydrotreating step is adjusted, and the operation of the naphtha fraction hydrotreating step is controlled so as to achieve the above conversion of 100% (reaction temperature adjustment step).

A specific example of a method of adjusting the reaction temperature in the naphtha fraction hydrotreating step in the present embodiment based on the train of thought outlined above is described below.

Figure 3:
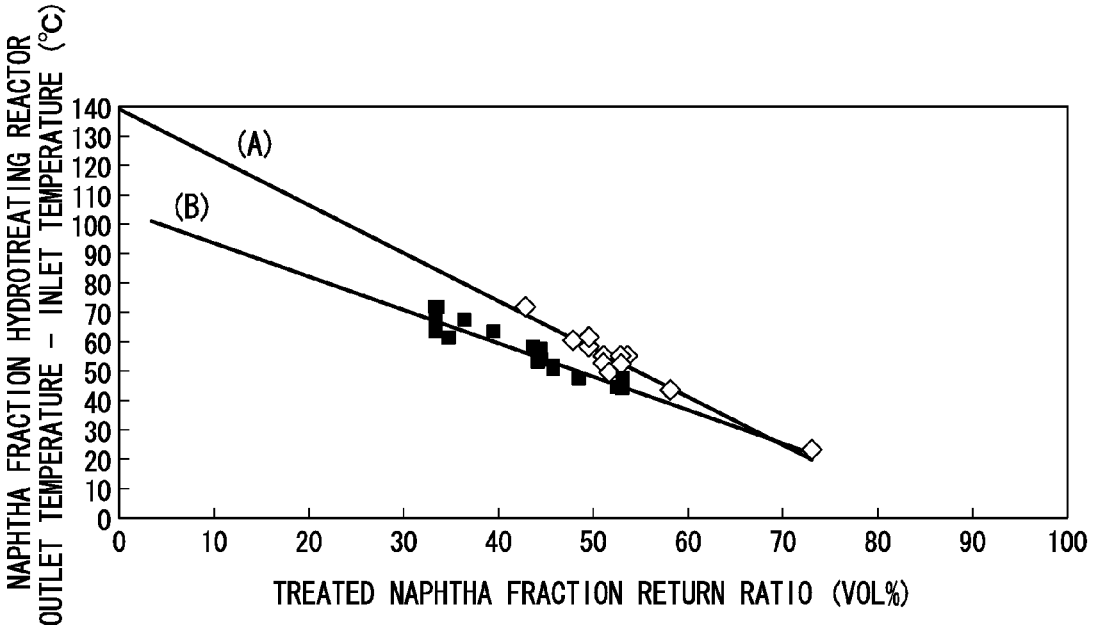
FIG. 3 is a graph illustrating measured values for the difference between the naphtha fraction hydrotreating reactor outlet temperature and inlet temperature, relative to the ratio of the flow rate of the treated naphtha fraction returned to the naphtha hydrotreating hydrotreating step relative to the flow rate of the treated naphtha fraction discharged from the naphtha hydrotreating hydrotreating step.

FIG. 3 is a graph prepared by plotting actual performance values for the treated naphtha fraction return ratio in the naphtha fraction hydrotreating step, and the reactor temperature difference for the naphtha fraction hydrotreating reactor, at different reaction temperatures in the FT synthesis reaction step. The line (A) in the graph represents a relationship between the treated naphtha fraction return ratio and reactor temperature difference when the reaction temperature in the FT synthesis reaction step is 220° C., and the line (B) represents that relationship when the reaction temperature in the FT synthesis reaction step is 230° C. Further, for each plotted point, analysis of the treated naphtha fraction was carried out to confirm that the olefins and alcohols had been removed with a conversion of substantially 100%.

In FIG. 3, when the reaction temperature in the FT synthesis reaction step is low, the reactor temperature difference for the naphtha fraction hydrotreating reactor 54 increases. As described above, this is because as the reaction temperature in the FT synthesis reaction step is lowered, the production of the olefins and alcohols increases, meaning the concentration of the olefins and alcohols within the resulting raw naphtha fraction increases, and the amount of heat generated per unit volume of the mixed naphtha fraction in the naphtha fraction hydrotreating step also increases. Further, as the treated naphtha fraction return ratio is increased, the reactor temperature difference decreases. As described above, this is because increasing the treated naphtha fraction return ratio reduces the concentration of the olefins and alcohols within the mixed naphtha fraction, thereby reducing the amount of heat generated per unit volume of the mixed naphtha fraction in the naphtha fraction hydrotreating step.

In this manner, the fact that the reactor temperature difference in the naphtha fraction hydrotreating step correlates with the reaction temperature in the FT synthesis reaction step and the treated naphtha fraction return ratio in the naphtha fraction hydrotreating step is supported by the actual performance results shown in FIG. 3. Accordingly, by using the type of correlative relationship based on the actual performance values shown in FIG. 3, an estimated reactor temperature difference for the case where the conversion of the olefins and alcohols in the naphtha fraction hydrotreating step is 100% can be determined on the basis of the reaction temperature in the FT synthesis reaction step and the treated naphtha fraction return ratio in the naphtha fraction hydrotreating step (reactor temperature difference estimation step).

Next, the temperature measuring devices 54*f* and 54*g* installed in the naphtha fraction hydrotreating reactor 54 at the inlet and outlet respectively are used to measure the inlet temperature and the outlet temperature, and the measured reactor temperature difference is determined (reactor temperature difference measurement step). The estimated reactor temperature difference and the measured reactor temperature difference are then compared.

If the estimated reactor temperature difference and the measured reactor temperature difference are substantially equal, then this means that the olefins and alcohols contained within the raw naphtha fraction are being removed in the naphtha fraction hydrotreating step at a conversion of substantially 100%.

On the other hand, a measured reactor temperature difference that is smaller than the estimated reactor temperature difference means that the conversion has not reached 100%, and a portion of the olefins and alcohols contained within the raw naphtha fraction remains within the treated naphtha fraction. Moreover, a larger difference between the two values, namely a larger value for the difference obtained by subtracting the measured reactor temperature difference from the estimated reactor temperature difference, indicates a lower conversion for the olefins and alcohols, and therefore a higher concentration of residual olefins and alcohols within the treated naphtha fraction. Accordingly, in order to increase the measured reactor temperature difference to substantially the same value as the estimated reactor temperature difference, operation of the naphtha fraction hydrotreating step is adjusted so that the amount of heat applied to the mixed naphtha fraction by the heater 54*e* is increased, thereby raising the hydrotreating reaction temperature and increasing the conversion of the olefins and alcohols so that substantially no olefins or alcohols are retained within the treated naphtha fraction. As will be evident from the above train of thought, the measured reactor temperature difference typically does not exceed the estimated reactor temperature difference.

In this manner, the hydrotreating reaction temperature in the naphtha fraction hydrotreating reactor 54 is adjusted (reaction temperature adjustment step).

The reaction temperature in the naphtha fraction hydrotreating step in the present embodiment (namely, the hydrotreating temperature) is determined via the process described above, and is typically within a range from 180 to 400° C., preferably from 280 to 350° C., and more preferably from 300 to 340° C. Here, the hydrotreating temperature refers to the average temperature of the catalyst layer in the naphtha fraction hydrotreating reactor 54. Provided the hydrotreating temperature is at least as high as the lower limit of the above temperature range, the naphtha fraction undergoes satisfactory hydrotreating, and provided the temperature is not higher than the upper limit of the above temperature range, any reduction in the life of the catalyst can be suppressed.

The pressure (hydrogen partial pressure) in the naphtha fraction hydrotreating reactor is preferably within a range from 0.5 to 12 MPa, and more preferably from 1 to 5 MPa. Provided the pressure in the naphtha fraction hydrotreating reactor is at least 0.5 MPa, the raw naphtha fraction undergoes satisfactory hydrotreating, and provided the pressure is not higher than 12 MPa, equipment costs associated with increasing the pressure resistance of the equipment can be kept to a minimum.

The liquid hourly space velocity (LHSV) in the naphtha fraction hydrotreating step is preferably within a range from 0.1 to 10 $h^{-1}$, and more preferably from 0.3 to 3.5 $h^{-1}$. Provided the LHSV is at least 0.1 $h^{-1}$, the capacity of the naphtha fraction hydrotreating reactor need not be excessively large, and provided the LHSV is not higher than 10 $h^{-1}$, the raw naphtha fraction can be hydrotreated efficiently.

The hydrogen gas/oil ratio during the naphtha fraction hydrotreating step is preferably within a range from 50 to 1,000 NL/L, and is more preferably from 70 to 800 NL/L. In this description, the units "NL" represents the hydrogen gas volume (L) under standard conditions (0° C., 101,325 Pa). Provided the hydrogen gas/oil ratio is at least 50 NL/L, the raw naphtha fraction undergoes satisfactory hydrotreating, and provided the hydrogen gas/oil ratio is not higher than 1,000 NL/L, increases in the equipment and operational costs associated with supplying a large volume of hydrogen gas can be suppressed.

As described above, in the above embodiment of a process for hydrotreating a naphtha fraction, an estimated reactor temperature difference is determined for the naphtha fraction hydrotreating reactor 54 based on the reaction temperature in the FT synthesis reaction step and the treated naphtha fraction return ratio in the naphtha fraction hydrotreating step, and the hydrotreating temperature is then adjusted on the basis of the difference between this estimated reactor temperature difference and the measured reactor temperature difference. Accordingly, the conversion of the olefins and alcohols can be ascertained rapidly, without sampling and analyzing the treated naphtha fraction (and in some cases the raw naphtha fraction), and the hydrotreating temperature can be set and adjusted on the basis of the ascertained conversion.

Accordingly, in the process for hydrotreating a naphtha fraction according to this embodiment, a simplified process can be used to rapidly determine and then adjust the ideal hydrotreating temperature, and the conversion of the olefins and alcohols can be stably maintained at 100%, so that substantially no olefins or alcohols are retained within the treated naphtha fraction.

The process for producing a hydrocarbon oil according to the present invention is the process for producing the hydrocarbon oil of a naphtha fraction using the above process for hydrotreating the naphtha fraction, and the hydrocarbon oil can be obtained effectively.

While preferred embodiments of the present invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

In the above embodiments, hydrocarbon compounds synthesizes in a FT synthesis reaction step are fractionally distilled into three fractions, namely a raw naphtha fraction, raw middle distillate and raw wax fraction, in the first fractionator in which two cut points (150° C. and 360° C.) are set. However, the hydrocarbon compounds may be fractionally distilled into two fractions, namely "a raw naphtha-middle fraction" and raw wax fraction, in the first fractionator in which a single cut point (for example 360° C.) is set. In this case, the middle distillate hydrotreating reactor 52 and naphtha fraction hydrotreating reactor 54 are integrated to a single "naphtha-middle fraction hydrotreating reactor", and the naphtha-middle fraction is hydrotreated in a single process.

In this hydrotreating of the naphtha-middle fraction, a portion of a treated naphtha-middle fraction discharged from the naphtha-middle fraction hydrotreating reactor may be returned to the naphtha-middle fraction hydrotreating reactor. In this case, by reading "naphtha-middle fraction" for "naphtha fraction" in the above description about a process for hydrotreating a naphtha fraction, hydrotreating of the naphtha-middle fraction can be performed with the same procedure.

On the other hand, the lower the boiling point of each of the fractions composing the hydrocarbon compounds synthesized in the FT synthesis reaction step is, the higher the content of the olefins and alcohols within the fraction is, as describe above. Accordingly, the raw naphtha-middle fraction obtained in a factional distillation with a single cut point contains lower content of the olefins and alcohols comparing to the raw naphtha fraction obtained in a factional distillation with two cut points. Therefore, temperature increasing in the reactor for hydrotreating of the raw naphtha-middle fraction is small comparing to the hydrotreating of the raw naphtha fraction. Thus, in some cases, returning a portion of the treated naphtha-middle fraction to the naphtha-middle fraction hydrotreating reactor may not be necessary. In those cases, in the reactor temperature difference estimation step, it is possible to estimate the difference between the naphtha-middle fraction hydrotreating reactor outlet temperature and inlet temperature based on only the reaction temperature in the FT synthesis reaction step without considering the treated naphtha-middle fraction return ratio in the reactor temperature difference estimation step. Then, based on the estimation, the hydrotreating of the naphtha-middle fraction can be carried out by the same method as above-mentioned embodiments of the hydrotreating of the naphtha fraction.

INDUSTRIAL APPLICABILITY

The present invention relates to a process for hydrotreating a naphtha fraction in which a naphtha fraction contained within hydrocarbon compounds synthesized in a Fischer-Tropsch synthesis reaction step is hydrotreated in a naphtha fraction hydrotreating step, and a portion of a treated naphtha fraction discharged from the naphtha fraction hydrotreating step is returned to the naphtha fraction hydrotreating step, wherein the process includes a reactor temperature difference estimation step of estimating a difference between a naphtha fraction hydrotreating reactor outlet temperature and inlet temperature, based on a reaction temperature of the Fischer-Tropsch synthesis reaction step, and a ratio of a flow rate of the treated naphtha fraction returned to the naphtha fraction hydrotreating step relative to a flow rate of the treated naphtha fraction discharged from the naphtha fraction hydrotreating step, a reactor temperature difference measurement step of measuring the difference between the naphtha fraction hydrotreating reactor outlet temperature and inlet temperature, and a reaction temperature adjustment step of adjusting a reaction temperature of the naphtha fraction hydrotreating step so that the difference between the naphtha fraction hydrotreating reactor outlet temperature and inlet temperature measured in the reactor temperature difference measurement step becomes substantially equal to the difference between the naphtha fraction hydrotreating reactor outlet temperature and inlet temperature estimated in the reactor temperature difference estimation step, and a process for producing a hydrocarbon oil using the process for hydrotreating a naphtha fraction.

According to the present invention, the degree of progression of impurity removal can be ascertained rapidly without analyzing the treated naphtha fraction, and by adjusting the hydrotreating reaction temperature based on the ascertained degree of progression, the naphtha fraction hydrotreating step can be controlled appropriately and rapidly via a simple process. Furthermore, a hydrocarbon oil of naphtha fraction can be produced effectively.

DESCRIPTION OF THE REFERENCE SIGNS

54: Naphtha fraction hydrotreating reactor
54*a*: Raw naphtha fraction supply line
54*b*: Treated naphtha fraction feed line
54*c*: Return line
54*d*: Hydrogen gas supply line
54*e*: Heater
54*f*, 54*g*: Temperature measuring device

The invention claimed is:

1. A process for hydrotreating a naphtha fraction, comprising:

a naphtha fraction hydrotreating step of hydrotreating a naphtha fraction contained within hydrocarbon compounds synthesized by a Fischer-Tropsch synthesis reaction in a naphtha fraction hydrotreating reactor;

a naphtha fraction discharging step of discharging the hydrotreated naphtha fraction from the naphtha fraction hydrotreating reactor;

a naphtha fraction return step of returning a portion of the treated naphtha fraction discharged from the naphtha fraction hydrotreating reactor thereto;

a temperature difference estimation step of estimating a temperature difference between a naphtha fraction hydrotreating reactor outlet temperature and inlet temperature, in reference to the Fischer-Tropsch synthesis reaction temperature and a return ratio of the flow rate of the hydrotreated naphtha fraction to be returned to the naphtha fraction hydrotreating reactor relative to the flow rate of the hydrotreated naphtha fraction discharged from the naphtha fraction reactor;

a temperature difference measurement step of measuring an actual temperature difference between the naphtha fraction hydrotreating reactor outlet temperature and inlet temperature; and a reaction temperature adjustment step of adjusting a reaction temperature in the naphtha fraction hydrotreating reactor so that the actual temperature difference measured in the temperature difference measurement step becomes substantially equal to the estimated difference in the temperature difference estimation step.

2. The process for hydrotreating a naphtha fraction according to claim 1, wherein a correlative relationship of the Fischer-Tropsch synthesis reaction temperature and the return ratio is referred to in the temperature difference estimation step, and wherein the correlative relationship is determined in advance based on an analysis of measured hydrotreating reactor temperature differences at various return ratios of the hydrotreated naphtha fraction when a conversion of olefins and alcohols contained in the naphtha fraction prepared from the Fischer-Tropsch synthesis reaction at a predetermined temperature is substantially 100% .

3. The process for hydrotreating a naphtha fraction according to claim 1, wherein the reaction temperature in the naphtha fraction hydrotreating reactor is adjusted by heating the naphtha fraction to be introduced to the naphtha fraction hydrotreating reactor, in the reaction temperature adjustment step.

4. A process for producing a hydrocarbon oil, comprising:

a Fischer-Tropsch synthesis reaction step of synthesizing hydrocarbon compounds from a synthesis gas containing carbon monoxide gas and hydrogen gas by a Fischer-Tropsch synthesis reaction;

a naphtha fraction hydrotreating step of hydrotreating a naphtha fraction contained within the hydrocarbon compounds synthesized by the Fischer- Tropsch synthesis reaction step in a naphtha fraction hydrotreating reactor;

a naphtha fraction discharging step of discharging the hydrotreated naphtha fraction from the naphtha fraction hydrotreating reactor;

a naphtha fraction return step of returning a portion of the treated naphtha fraction discharged from the naphtha fraction hydrotreating reactor thereto;

a naphtha fraction fractional distillation step of fractionally distilling the remaining hydrotreated naphtha fraction, thereby obtaining a naphtha as a hydrocarbon oil;

a temperature difference estimation step of estimating a temperature difference between a naphtha fraction hydrotreating reactor outlet temperature and inlet temperature, in referenced to the Fischer-Tropsch synthesis reaction temperature and a return ratio of the flow rate of the hydrotreated naphtha fraction to be returned to the naphtha fraction hydrotreating reactor relative to the flow rate of the hydrotreated naphtha fraction discharged from the naphtha fraction reactor;

a temperature difference measurement step of measuring an actual temperature difference between the naphtha fraction hydrotreating reactor outlet temperature and inlet temperature; and a reaction temperature adjustment step of adjusting a reaction temperature in the naphtha fraction hydrotreating reactor so that the actual temperature difference measured in the reaction temperature difference measurement step becomes substantially equal to the estimated temperature difference in the temperature difference estimation step.

5. The process for producing a hydrocarbon oil according to claim 4, wherein a correlative relationship of the Fischer-Tropsch synthesis reaction temperature and the return ratio is referred to in the temperature difference estimation step, and wherein the correlative relationship is determined in advance based on an analysis of measured hydrotreating reactor temperature differences at various return ratios of the hydrotreated naphtha fraction when a conversion of olefins and alcohols contained in the naphtha fraction prepared from the Fischer-Tropsch synthesis reaction at a predetermined temperature is substantially 100%.

6. The process for producing a hydrocarbon oil according to claim 4, wherein the reaction temperature in the naphtha fraction hydrotreating reactor is adjusted by heating the naphtha fraction to be introduced to the naphtha fraction hydrotreating reactor, in the reaction temperature adjustment step.

* * * * *